US010309178B2

(12) United States Patent
Hart

(10) Patent No.: US 10,309,178 B2
(45) Date of Patent: Jun. 4, 2019

(54) MILLS WITH SHEARABLE CUTTING MEMBERS FOR MILLING CASINGS IN WELLBORES

(71) Applicant: Daniel R. Hart, Sugar Land, TX (US)

(72) Inventor: Daniel R. Hart, Sugar Land, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 397 days.

(21) Appl. No.: 14/947,543

(22) Filed: Nov. 20, 2015

(65) Prior Publication Data

US 2017/0145766 A1 May 25, 2017

(51) Int. Cl.
*E21B 29/00* (2006.01)

(52) U.S. Cl.
CPC ..... *E21B 29/005* (2013.01)

(58) Field of Classification Search
CPC ..... E21B 29/005; E21B 10/322; E21B 10/62; E21B 7/28
See application file for complete search history.

(56) References Cited

U.S. PATENT DOCUMENTS 5,018,580 A 5/1991 Skipper
5,201,817 A * 4/1993 Hailey ..... E21B 10/322 166/55.8
5,350,015 A * 9/1994 Hailey ..... E21B 10/322 166/55.8
5,351,758 A * 10/1994 Henderson ..... E21B 10/322 166/174
5,862,870 A * 1/1999 Hutchinson ..... E21B 29/005 166/55.8
6,131,675 A * 10/2000 Anderson ..... E21B 10/322 166/55.1
7,143,847 B2 * 12/2006 Pia ..... E21B 10/322 175/263
8,469,097 B2 * 6/2013 Cochran ..... E21B 29/005 166/298
2005/0061551 A1 3/2005 Degeare et al.
2011/0127044 A1 6/2011 Radford et al.
2013/0199785 A1 8/2013 Hekelaar
2014/0034317 A1 2/2014 Hekelaar
2015/0129195 A1 * 5/2015 Laird ..... E21B 29/005 166/55.8
2017/0145766 A1 * 5/2017 Hart ..... E21B 29/005

OTHER PUBLICATIONS

PCT International Search Report and Written Opinion; International Application No. PCT/US2016/057464; International Application Filing Date: Oct. 18, 2016; dated Jan. 24, 2017; pp. 1-13.

* cited by examiner

*Primary Examiner* — Daniel P Stephenson
(74) *Attorney, Agent, or Firm* — Cantor Colburn LLP

(57) ABSTRACT

A mill for milling a casing in a wellbore. The mill includes a plurality of radially extendable cutting members on a body. An activation device extends the cutting members radially outward from the body upon application of a hydraulic pressure to the activation device and mechanically retracts the blades upon removal of the hydraulic pressure from the activation device. The cutting members are separable from the body.

13 Claims, 2 Drawing Sheets

MILLS WITH SHEARABLE CUTTING MEMBERS FOR MILLING CASINGS IN WELLBORES

BACKGROUND

1. Field of the Disclosure

The disclosure herein relates to mills for milling casings in a wellbore and specifically to mills that can be sheared when trapped (also referred to herein as stuck or lodged) in the wellbore to remove the service strings utilized to convey such mills in the wellbores.

2. Background of the Art

Wellbores are drilled in subsurface formations for the production of hydrocarbons (oil and gas). Modern wells can extend to great well depths, often more than 15,000 ft. A wellbore is typically lined with casing (a string of metal tubulars connected in series) along the length of the wellbore to prevent collapse of the formation (rocks) into the wellbore. A variety of devices are installed in the wellbore to produce the hydrocarbons from the formation surrounding the wellbore from one or more production zones. Sometimes it is necessary to mill a part of the casing to perform a downhole operation or for other reasons. The casing section remaining above the milled portion is sometimes removed from the wellbore. To perform a milling and retrieving operations, a tool (commonly referred to as a mill, with cutting members (also referred to as knives or blades) is typically conveyed into the casing by a service string to mill a certain length of the casing at a desired location. Sometimes the mill becomes trapped or lodged in the casing, such as in the case of cutting members not retracting after the milling operation or due to another downhole condition. Some mills include a shear mechanism on the upper section of or above the mill that allows an operator to over-pull the service string to cause the mill to separate from the service string and drop in the wellbore, which allows the operator to retrieve the service string to the surface. It is also desirable not to leave tools in the wellbore or minimize the size of such debris left or dropped in the wellbore so as to avoid performing secondary operations to remove tools left in the wellbore before performing operations needed at a later time or to not obstruct flow of fluids flowing through the wellbore or for other reasons.

The disclosure herein provides apparatus that provides, among other things, mills with shear mechanism that allows disconnecting cutting members from the mill when such mills are trapped in the wellbore.

SUMMARY

In one aspect, a mill for milling a casing is disclosed that in one non-limiting embodiment includes a plurality of radially extendable cutting members on a body, an activation device that extends the cutting members radially outward from the body upon application of a hydraulic pressure to the activation device and mechanically retracts the cutting members upon removal of the hydraulic pressure from the activation device, and wherein the cutting members are separable from the body.

In another aspect, a method of milling a casing in a wellbore is provided that in one non-limiting embodiment includes: conveying a string in the wellbore that includes a mill that contains a plurality of radially extendable cutting members on a body that are separable from the body of the mill and an activation device that extends the cutting members radially outward from the body upon application of a hydraulic pressure to the activation device and mechanically retracts the blades upon removal of the hydraulic pressure from the activation device; extending the cutting members to engage with the casing; rotating the mill while applying a pull force on the mill to mill the casing; and applying a pull force on the mill to disconnect the cutting members when the mill is trapped in the wellbore.

Examples of the more important features of an apparatus and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWING

For a detailed understanding of the apparatus and methods disclosed herein, reference should be made to the accompanying drawing and the detailed description thereof, wherein like elements are generally given same numerals and wherein.

DETAILED DESCRIPTION

Figure 1:
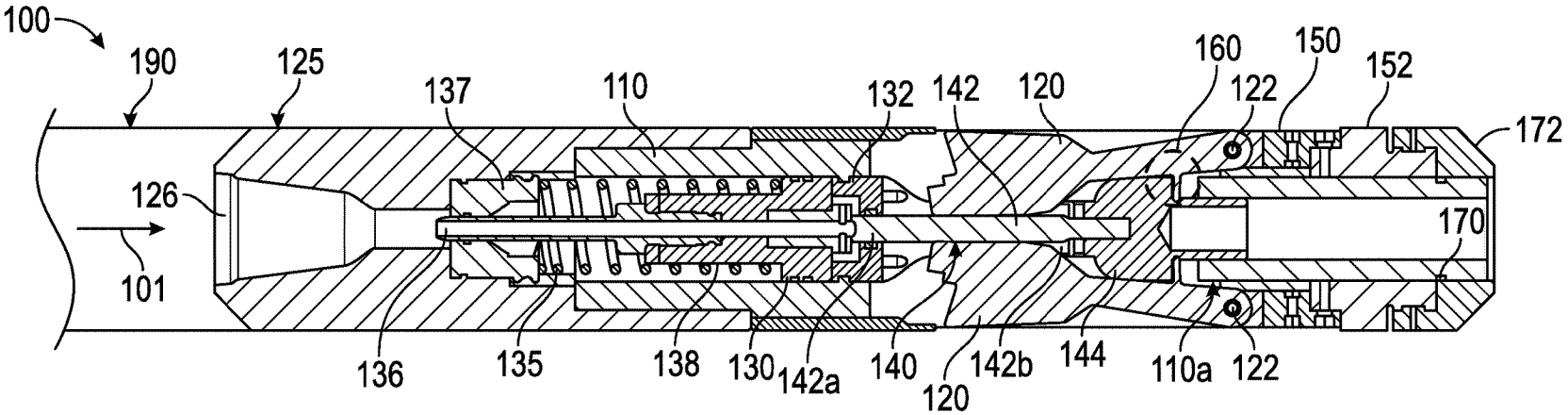
FIG. 1 shows a mill in the run-in position, according to one non-limiting embodiment of the disclosure.

FIG. 1 shows a mill 100 in the run-in position, according to a non-limiting embodiment of the disclosure. The mill 100 includes a body 110 having a number of cutting members or knives 120 radially arranged around the body 110. Each such knife is radially expandable outward about its pivot 122. In FIG. 1, the knives 120 are shown in the retracted or run-in position. The number of knives 120 varies depending on the application and is typically between six (6) and ten (10), wherein such knives are equally spaced around the body 110. The mill includes a top sub 125 for connection to a service string (not shown) and includes a fluid passage 126 for supplying a suitable fluid to the mill for activating the mill, i.e. radially expanding the knives 120. The mill 100 further includes a mill activation device or mechanism that includes a piston 130 that acts on a compression spring 135. The piston 130 is supported or held by a retainer 132 on its downhole end 133. An upper extension tube 136 moves upward and downward in a seal bearing 137 in the top sub 125 as the piston 130 moves upward and downward in its chamber 138. A mandrel assembly 140 coupled to a lower end of the piston is configured to radially extend outward the knives 120. The mandrel assembly 140 includes an extension rod 142 with its upper end 142*a* connected to the piston 130 and its lower end 142*b* connected to a knife opening device 144. A keeper 150 and a knife holder 152 hold the knives 120 in the body 110. The method of activating the blades 120 is described below. A knife tang 160 is provided to cause the knives to retract to their positions shown in FIG. 1. The knife tang 160 is connected on the bottom of the knives 120 and retracts as the piston 130 moves downward when the fluid pressure applied onto the piston 130 is removed. Thus, in the embodiment of FIG. 1, the knives 120 are hydraulically extended (pressure of fluid 101) and mechanically retraced (by spring activated knife tang 160). A shear member 170, including, but not limited to a shear ring, pin and screw retained in the lower part 110*a* of the body 110 by a shear retainer 172.

Figure 2:
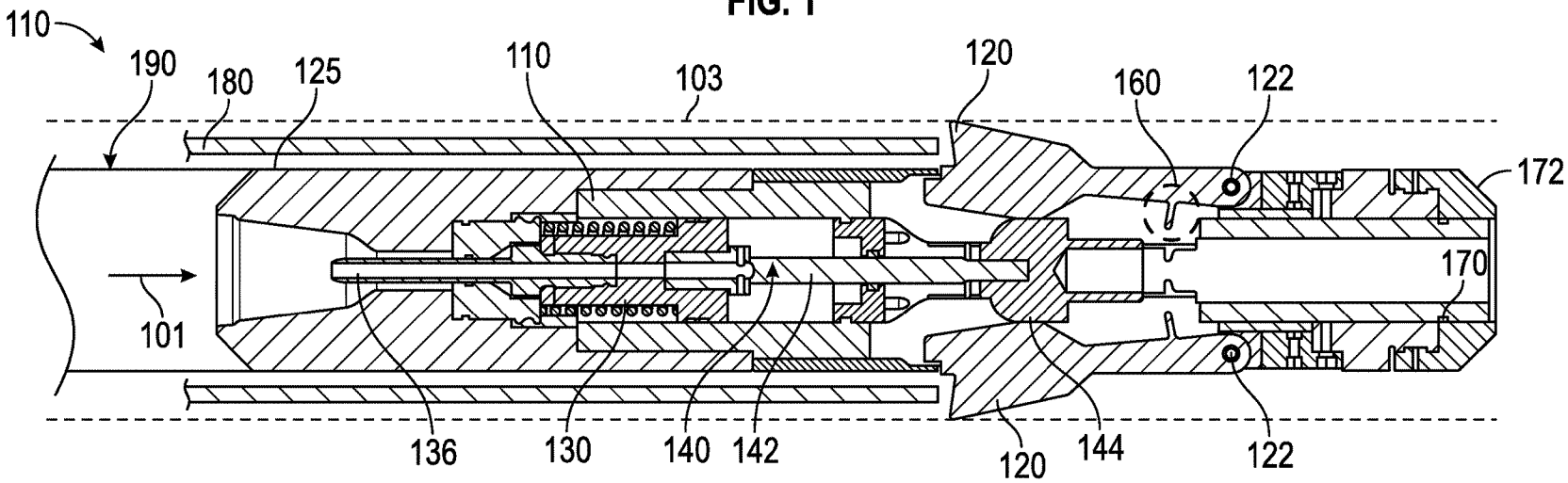
FIG. 2 shows the mill of FIG. 1 while in the milling position.

FIG. 2 shows the mill of FIG. 1 in the milling position. Referring to FIGS. 1 and 2, to activate the mill 100 to mill a casing 180 in a wellbore 103, a fluid 101 under pressure is supplied to the mill 100. The fluid 101 causes the piston 130 to move upward (left in FIG. 2), which compresses spring 135, which causes the upper extension tube 136, the extension member, such as rod, 142 and the knife expansion device 144 to move upward. The upward movement of the knife extension device causes the knives 120 to expand radially outward about their respective pivots 122, as shown in FIG. 2. As long as the fluid pressure is applied, the piston 120 remains in the upward position and the compression spring 135 remains compressed, as shown in FIG. 2. To mill the casing 180, knives 120 are rotated by a motor (not shown) in the string or by rotating the string 190 with upward tension on the mill 100. When the fluid pressure is removed, the piston 130 moves to the right and the knife tang 180 causes the knives 120 to retract as shown in FIG. 1. In the event one or more knives 120 do not retract, the string 190 cannot be moved upward to retrieve the mill 100 from the wellbore. The method of shearing a portion of the mill 100 to retrieve the string 190 are described below in reference to FIGS. 3 and 4.

Figure 3:
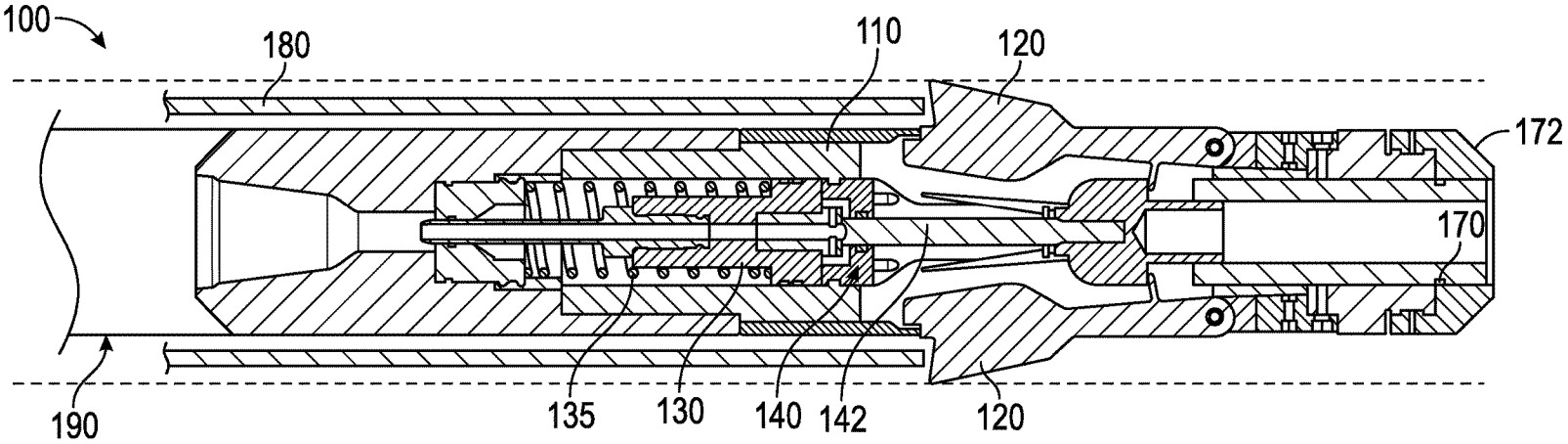
FIG. 3 shows the mill of FIG. 1 in a trapped position in the wellbore.
Figure 4:
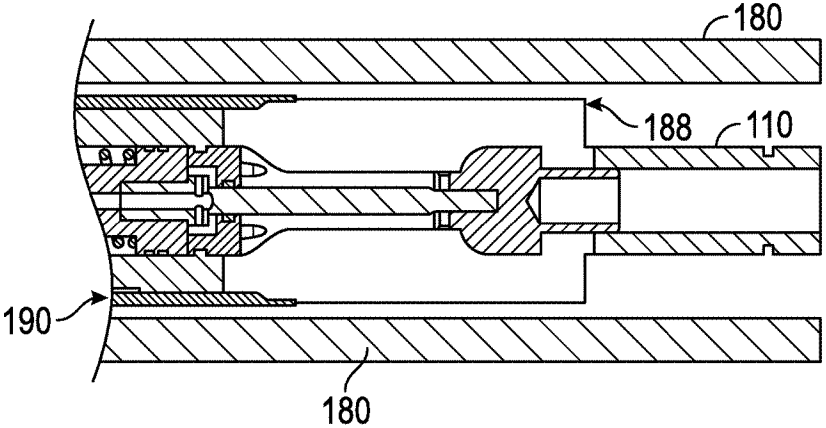
FIG. 4 shows portion of the mill of FIG. 3 after the cutting members have been disconnected or sheared off from the body of the mill.

FIG. 3 shows the piston 130 in the downward position as in FIG. 1 although the fluid pressure has been removed. The mandrel assembly 140, including the extension rod 142 and expansion device 144, also move downward with the piston 130 and attain the same position as in FIG. 1. When one or more knives 120 do not retract, such knives will remain extended and behind the casing 180 as shown in FIG. 3. To pull the string 190 out of the wellbore, the string 190 is pulled with a pull force that exceeds the shear strength of the shear member 170, causing the shear member 170 to shear. Shearing of the shear member 170 causes the shear retainer 172 along with the knives 120 to separate or disconnect from the body 110. The mill portion 188 after the blades 120 have been separated is shown in FIG. 4. The string 190 along with the mill portion 188 can now be retrieved from the wellbore by pulling up the string 190. The mill 100 described herein may also be configured for use for milling the casing in the downward direction. In such a case, to mill the casing 104, a push force is applied while rotating the cutting members 120 to mill the casing 104.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A mill, comprising:

a plurality of radially extendable cutting members on a body, wherein the cutting members are separable from the body;

an activation device including a piston that moves upward when a hydraulic pressure is applied on the activation device and moves downward when the hydraulic pressure is removed from activation device;

a knife extension device at a lower end of the piston, wherein the knife extension device moves upward with upward movement of the piston to extend the cutting members radially outward from the body upon application of the hydraulic pressure to the activation device and moves downward with a downward movement of the piston upon removal of the hydraulic pressure from the activation device to allow the blades to mechanically retract; and a shear device that shears when a pull force applied to the mill exceeds a selected value to separate the cutting members from the body.

2. The mill of claim 1, wherein the shear device includes a shear member retained by a retainer below the cutting members and wherein the shear member shears when the pull force exceeds the selected pull to disconnect the cutting members from the body.

3. The mill of claim 2, wherein the cutting members fall off the mill when separated from the body, leaving the activation device on the mill.

4. The mill of claim 1, wherein the piston acts on a compression spring.

5. The mill of claim 4, wherein removing the hydraulic pressure from the activation device causes the spring to expand to move the piston downward.

6. The mill of claim 5 further comprising a tang that is; (i) placed at bottom of the cutting members; (ii) retracts when the piston moves downward to retract the cutting members mechanically.

7. A method of milling a casing in a wellbore, the method comprising:

conveying a string in the wellbore, the string having a mill that includes:

a plurality of radially extendable cutting members on a body of the mill that are separable from the body, and an activation device including a piston that moves upward when a hydraulic pressure is applied on the activation device and moves downward when the hydraulic pressure is removed from activation device, a knife extension device at a lower end of the piston, wherein the knife extension device moves upward with upward movement of the piston to extend the cutting members radially outward from the body upon application of the hydraulic pressure to the activation device and moves downward with a downward movement of the piston upon removal of the hydraulic pressure from the activation device to allow the blades to mechanically retract; and a shear device that shears when a pull force applied to the mill exceeds a selected value to separate the cutting members from the body;

applying the hydraulic pressure on the activation device to extend the cutting members to engage with the casing; and operating the mill while applying one of a pull force and a push force on the mill to mill the casing.

8. The mill of claim 7, wherein the shear device includes a shear ring retained by retainer below the cutting members and wherein the shear ring shears off when the pull force exceeds the selected pull on the mill to disconnect the cutting members from the body.

9. The method of claim 8 further comprising removing the cutting members from the body by pulling the mill when the mill is trapped in the wellbore.

10. The method of claim 9 further comprising pulling the mill with a selected pull force to cause the shear ring to shear to separate the cutting members from the body when the mill is trapped in the wellbore and allowing the cutting members to fall in the wellbore while leaving the body and the activation device on the mill.

11. The method of claim 7, wherein the piston acts on a compression spring.

12. The mill of claim 11, wherein removing the hydraulic pressure from the activation device causes the spring to expand to move the piston downward.

13. The mill of claim 12 further comprising a tang that is; (i) placed at bottom of the cutting members; (ii) retracts when the piston moves downward to mechanically retract the cutting members.

* * * * *